United States Patent [19]

Philipp

[11] Patent Number: 4,495,482

[45] Date of Patent: Jan. 22, 1985

[54] METAL OXIDE VARISTOR WITH CONTROLLABLE BREAKDOWN VOLTAGE AND CAPACITANCE AND METHOD OF MAKING

[75] Inventor: Herbert R. Philipp, Scotia, N.Y.

[73] Assignee: General Electric Company, Schenectady, N.Y.

[21] Appl. No.: 504,770

[22] Filed: Jun. 16, 1983

Related U.S. Application Data

[63] Continuation of Ser. No. 295,901, Aug. 24, 1981, abandoned.

[51] Int. Cl.[3] ..... H01C 7/12

[52] U.S. Cl. ..... 338/21; 357/10; 427/101; 427/103; 427/372.2; 427/404; 427/419.2; 29/621; 338/20

[58] Field of Search ..... 338/21, 22 SD, 20; 357/10; 427/85, 80, 101, 102, 126.3, 376.2, 380, 103, 372.2, 404, 419.2; 29/621

[56] References Cited

U.S. PATENT DOCUMENTS

| | | | |
|---|---|---|---|
| 3,723,175 | 3/1973 | Masuyama et al. | 117/201 |
| 3,760,318 | 9/1973 | Masuyama et al. | 338/21 |
| 3,899,451 | 8/1975 | Ichinose et al. | 252/520 |
| 4,147,670 | 4/1979 | Shohata et al. | 252/519 |

FOREIGN PATENT DOCUMENTS 1538825 1/1979 United Kingdom .

*Primary Examiner*—Richard Bueker

*Attorney, Agent, or Firm*—Robert J. Jarvis; James C. Davis, Jr.; Marvin Snyder

[57] ABSTRACT

A metal oxide varistor with controllable breakdown voltage and capacitance characteristics is fabricated by controlled diffusion of lithium into conventional metal oxide varistor material at elevated temperature. The varistor layer containing lithium exhibits an increased breakdown voltage, lowered capacitance, and low leakage current while maintaining a high coefficient of nonlinearity.

19 Claims, 1 Drawing Figure

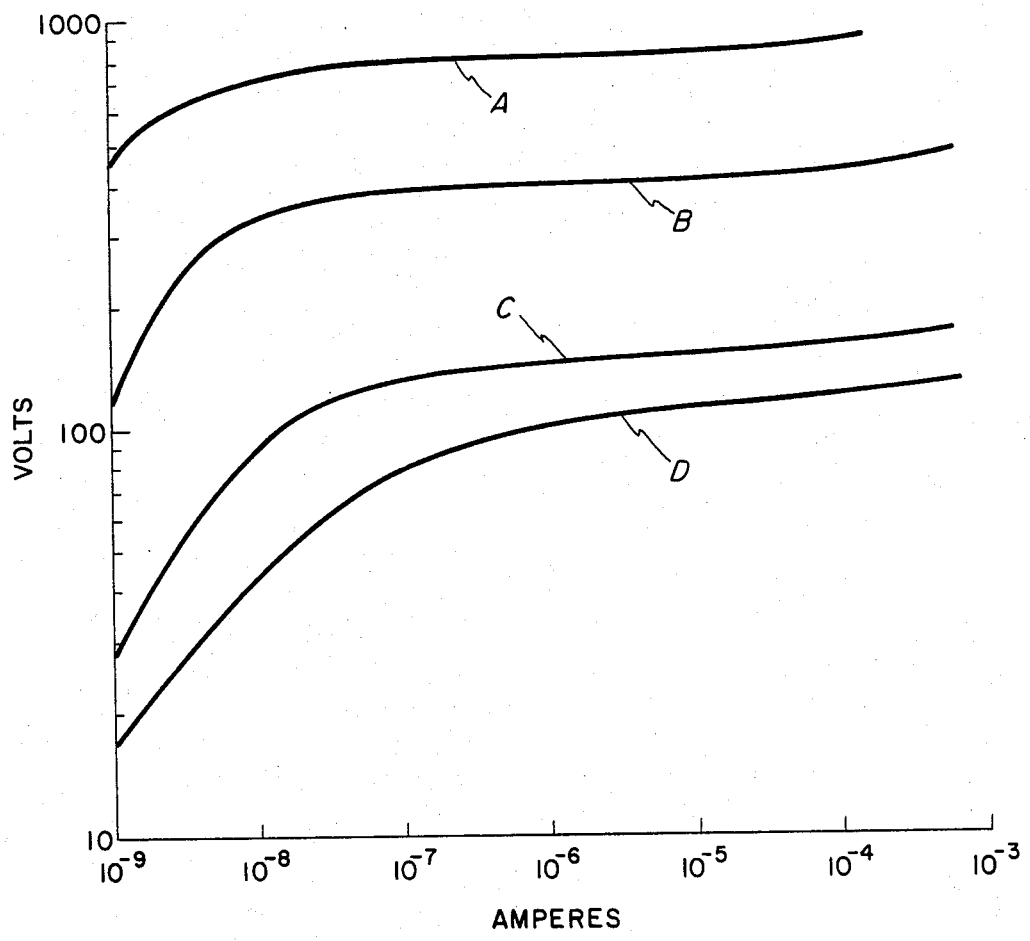
1000
100
10
VOLTS
A
B
C
D
$10^{-9}$
$10^{-8}$
$10^{-7}$
$10^{-6}$
$10^{-5}$
$10^{-4}$
$10^{-3}$
AMPERES

METAL OXIDE VARISTOR WITH CONTROLLABLE BREAKDOWN VOLTAGE AND CAPACITANCE AND METHOD OF MAKING

This application is a continuation of application Ser. No. 295,901, filed 8/24/81, now abandoned.

BACKGROUND OF THE INVENTION

This invention relates to metal oxide varistors and, in particular, to lithium-doped zinc oxide based varistors with controllable breakdown voltage and capacitance.

In general, a metal oxide varistor comprises a zinc oxide (ZnO) based ceramic semiconductor device with a highly nonlinear current-voltage relationship which may be represented by the equation $I=(V/C)^{\alpha}$, where V is the voltage between two points separated by the varistor material, I is the current flowing between the points, C is a constant, and $\alpha$ is a measure of device nonlinearity. If $\alpha=1$, the device exhibits ohmic properties. For values of $\alpha$ greater than 1 (typically 20–50 or more for ZnO based varistors), the voltage-current characteristics are similar to those exhibited by back-to-back connected Zener diodes. Varistors, however, have much greater voltage, current, and energy-handling capabilities. If the voltage applied to the varistor is less than the varistor breakdown voltage, only a small leakage current will flow between the electrodes and the device is essentially an insulator having a resistance of many megohms. However, if the applied voltage is greater than the varistor breakdown voltage, the varistor resistance drops to low values permitting large currents to flow through the varistor. Under varistor breakdown conditions, the current through the varistor varies greatly for small changes in applied voltage so that the voltage across the varistor is effectively limited to a narrow range of values. The voltage limiting or clamping action is enhanced at higher values of $\alpha$.

Metal oxide varistors have been widely employed as surge arresters for protecting electrical equipment from transients on AC power lines created by lightning strikes or switching of electrical apparatus. Such applications require the use of varistors having breakdown voltages slightly greater than the maximum input voltage of the system to be protected. Thus, for example, a typical system powered from 170 volts peak voltage (120 volts rms) AC power mains would require the use of a varistor having a breakdown voltage somewhat greater than 170 volts.

Varistor device behavior may be approximately modeled by a variable resistor in parallel with a capacitor. The parasitic capacitance modeled by the capacitor is an intrinsic property associated with the particular varistor composition, and is generally undesirable as it may affect varistor performance in surge-protective or switching applications, for example. In typical surge-arrester applications, the varistor is subjected to a continuously applied voltage. Although the applied voltage is lower than the varistor breakdown voltage, an undesirable current, due predominantly to the parasitic capacitance, flows through the varistor. In high frequency circuits this current flow may be large enough to affect normal operation of the circuit.

Another capacitance-related problem (described in greater detail in U.S. Pat. No. 4,276,578, issued to L. M. Levinson, and assigned to the same assignee as the present invention) arises in surge-arrester devices made up of stacked metal oxide varistors. In such devices, each varistor in the stack has in addition to the parasitic capacitance associated therewith, a coupling capacitance to ground. As a result of the combined effect of the parasitic and ground capacitance, particularly ground capacitance, a larger current flows through the top varistors (those nearest the line) in the stack since these varistors also pass the capacitive ground currents which flow through the lower varistors. The upper varistors therefore are required to dissipate greater power, resulting in higher operating temperature, inferior stability, and concomittantly shorter useful life due to premature failure. In conventional systems, discrete, low dissipation capacitors are connected in parallel with the varistors to achieve a more uniform voltage and power distribution throughout the stacked varistors. Use of capacitors with graded intrinsic capacitances, as described in the aforementioned patent, is a more effective solution.

Varistor elements may also be used as switching elements for multiplexing, for example, liquid crystal displays. In such applications, the parasitic capacitance is also a problem, since it appears in series with the capacitance of the liquid crystal material, forming a capacitive voltage divider. A lower electric field than would otherwise be available is thus used to maintain the liquid crystal material in its active state. Additionally, if the varistor capacitance is too high, nonselected elements in the liquid crystal array may be inadvertently activated by pulses applied to the display. A more detailed description of multiplexing liquid crystal displays using varistors appears in U.S. Pat. No. 4,223,603 issued to D. E. Castleberry and in application Ser. No. 233,423 filed Apr. 11, 1981 by L. M. Levinson, both assigned to the same assignee as the present invention.

From the foregoing the importance and desirability of reducing varistor capacitance is apparent. Aforementioned U.S. Pat. No. 4,276,578 discloses the inclusion of antimony oxide ($Sb_2O_3$) in the varistor for the purpose of decreasing intrinsic capacitance. The present invention provides varistors with high breakdown voltage and low capacitance by controlled diffusion of lithium into conventional zinc oxide varistor material.

SUMMARY OF THE INVENTION

In accordance with the present invention, a zinc oxide based varistor exhibiting a high breakdown voltage and low capacitance is fabricated by diffusing lithium into conventional metal oxide varistor material at elevated temperatures. The diffusion of lithium must be carefully controlled, otherwise the varistor becomes insulating for applied voltages even as high as ten or more times the normal breakdown voltage. Lithium may be diffused into the varistor material by placing a solution containing $LiNO_3$ or $Li_2O$ on the varistor surface. Solvents such as alcohol or acetone may be air dried while aqueous solutions should be heated in air to remove the water. Following the drying step, lithium surface concentration should not exceed approximately 2 mg/cm$^2$. The varistor material is then heated at, for instance, 800° C. for approximately one hour. Temperatures between 500° C. and 1100° C., however may be employed. The penetration of lithium into the varistor is determined by the time and temperature of the diffusion step. Given sufficient time, lithium may be diffused completely through the varistor material. For varistors in which lithium diffusion is limited to a thin layer on one side of the varistor, conventional surface electrodes may be employed.

It is an object of the invention to provide a metal oxide varistor exhibiting high breakdown voltage and low capacitance.

It is another object of the invention to provide a metal oxide varistor exhibiting controllable breakdown voltage and capacitance characteristics.

It is still another object of the invention to provide a zinc oxide varistor containing diffused lithium and which has high breakdown voltage, low capacitance, and low leakage current.

BRIEF DESCRIPTION OF THE DRAWING

The features of the invention believed to be novel are set forth with particularity in the appended claims. The invention itself, however, both as to its organization and method of operation, together with further objects and advantages thereof, may best be understood by reference to the following description taken in conjunction with the accompanying drawing in which the single FIGURE depicts voltage-current characteristic curves of a metal oxide varistor produced in accordance with the present invention.

DETAILED DESCRIPTION OF THE INVENTION

In the past, high-resistance surface layers containing lithium and potassium have been produced by diffusion of $Li_2CO_3$ or $Li_2O$ and $K_2CO_3$ or $K_2O$ into zinc oxide varistor materials. The lithium and potassium are diffused into the sides of the varistor disk or rod, for example, while the electrodes are affixed to the flat end portions. In this manner, the nonlinearity of the varistor is unaffected in the undoped varistor material portions, while the doped regions provide a high-resistance. Since the doped layer has a high resistance, it does not appear to have a nonohmic voltage characteristic, typical of varistor behavior. In fact, by virtue of its high resistance, the doped layer could aid in avoiding voltage flashover between the electrodes from occuring along the sides of the varistor disk or rod.

In contrast, in accordance with the present invention, the quantity of lithium diffused into the varistor material is carefully controlled to preserve the nonohmic voltage characteristics associated with the varistor material. If relatively large amounts of lithium (described hereinafter) are diffused, the varistor material becomes insulating for applied voltages even as high as ten or more times the normal breakdown voltage. Such highly doped varistor materials do not exhibit varistor breakdown conduction. If the applied voltage is increased sufficiently, catastrophic conduction results. For smaller amounts of lithium dopant, however, a varistor having a high $\alpha$, increased breakdown voltage, and lower capacitance than that obtained with similar undoped varistor material is realized.

In order to practice the invention, lithium may be diffused into any conventional zinc oxide varistor material. Such varistor materials may conveniently comprise any of the standard compositions employed in fabricating metal oxide varistors by conventional methods. Typically, such varistors have zinc oxide (ZnO) as the primary constituent (typically, 90 mole percent or more) and include smaller quantities of other metal oxide additives, such as bismuth oxide ($Bi_2O_3$), cobalt oxide ($Co_2O_3$), chromium oxide ($Cr_2O_3$) as well as other additives which may include additional metal oxides. Examples of such additives include manganese oxide ($MnO_2$), antimony trioxide ($Sb_2O_3$), silicon dioxide ($SiO_2$), nickel oxide (NiO), magnesium oxide (MgO), aluminum nitrate ($Al(NO_3)_3 \cdot 9(H_2O)$), tin oxide ($SnO_2$), titanium oxide ($TiO_2$), nickel fluoride ($NiF_2$), barium carbonate ($BaCO_3$), and boric acid ($H_3BO_3$). The list of additives is not intended to be exhaustive, nor, generally are all of the above-enumerated materials employed in a single varistor composition. By way of example, and not limitation, a varistor material suitable for practicing the invention may comprise 0.5 mole percent each of $Bi_2O_3$, $Co_2O_3$, $MnO_2$, and $SnO_2$, 0.1 mole percent each of $H_3BO_3$ and $BaCo_3$, 1 mole percent $Sb_2O_3$, the remainder being ZnO. The additive elements may be added to the unfired varistor mixture as any convenient salt of the additive element since upon sintering these compounds decompose into oxides of the element.

Lithium may be diffused into varistor material by placing thereon a suitable paste or a solution of lithium nitrate ($LiNO_3$) or lithium oxide ($Li_2O$). Solutions using alcohol (such as methanol) or acetone may be air dried. If an aqueous solution is used, the varistor is initially heated at a low temperature such as 100° C. to evaporate the water. Resulting surface concentration of $LiNO_3$ or $Li_2O$ on the varistor should not exceed approximately 2 mg/cm$^2$. The varistor material is then heated in air at temperatures as high as 1100° C. The usual time versus temperature tradeoffs apply and the penetration of lithium into the varistor is determined by the time and temperature of the diffusion step. For a varistor heated for one hour at 600° C., lithium penetration is in the order of a few mils, while at 900° C. it is on the order of a few millimeters. If sufficient time is allowed, the lithium can be made to completely penetrate the varistor.

In applications where attaching electrodes to the opposite sides of the varistor material is inconvenient, impractical, or where it is desired to control electrode separation, electrodes may be attached adjacent to one another on the doped side of the varistor material.

The FIGURE illustrates voltage-current characteristics of lithium doped and undoped varistor material having the aforedescribed exemplary composition into which lithium has been diffused by heating in air at 800° C. for one hour, and on which surface electrodes were positioned 1 mm apart. Varistor breakdown voltage is indicated on the vertical axis, while corresponding current values are shown on the horizontal axis. Curves A, B, and C depict varistor characteristics of a lithium-doped varistor surface corresponding to depths of 2, 7.5, and 15 thousandths of an inch, respectively. In obtaining the voltage-current characteristics at various depths, to illustrate the dependence of breakdown voltage and varistor capacitance on lithium dopant concentration, successive varistor material layers were removed by lapping, electrodes attached, and the varistor characteristics measured. Curves A, B, and C represent progressively lower lithium concentrations. Curve D depicts the charcteristics of an undoped varistor surface. It will be observed that for curves A, B, and C, capacitance values are 20 pf, 40 pf, and 70 pf, respectively, while breakdown voltages are 840, 410, and 155 volts, respectively. For undoped varistor material the capacitance and breakdown voltage are 100 pf and 115 volts, resepctively. It is apparent, therefore, that near the varistor surface (Curve A, highest lithium doping), the breakdown voltage is approximately eight times larger and the capacitance approximately five times smaller than the undoped surface (Curve D).

It is apparent from the foregoing that the present invention provides a metal oxide based varistor with a controllable breakdown voltage and capacitance. More specifically, the invention provides a zinc oxide varistor containing lithium and which has high breakdown voltage, low capacitance, and low leakage current.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. A method for controlling the intrinsic capacitance and breakdown voltage of a body of sintered zinc oxide based varistor material, said body possessing at least two substantially planar, parallel surfaces for electrode attachment, said body nonetheless retaining the nonohmic voltage-current properties of said varistor material, said method comprising:

diffusing lithium into the bulk of said varistor material by applying, to at least one of said parallel planar surfaces of said varistor body, a composition containing lithium such that the lithium concentration thereon is less than 2 mg/cm$^2$, and then heating said varistor material at elevated temperatures for a time sufficient to cause diffusion of at least a portion of said lithium into said varistor body, whereby the intrinsic capacitance of said varistor material decreases and the breakdown voltage of said varistor body increases as the concentration of diffused lithium therein increases; and attaching at least one electrode to said planar surface having said lithium composition applied thereto.

2. The method of claim 1 wherein said composition comprises a solution of at least one compound selected from the group consisting of $LiNO_3$ and $Li_2O$.

3. The method of claim 2 further comprising the step of evaporating the solvent in said solution prior to said step of heating.

4. The method of claim 1 wherein said step of heating comprises heating said varistor material in air at a temperature of between 500° C. and 1100° C.

5. The method of claim 4 wherein said varistor comprises a composition consisting essentially of 0.5 mole percent each of $Bi_2O_3$, $Co_2O_3$, $MnO_2$, and $SnO_2$, 0.1 mole percent each of $H_3BO_3$ and $BaCO_3$, 1 mole percent $Sb_2O_3$, the remainder being ZnO.

6. The method of claim 5 wherein said step of heating comprises heating said varistor material at 800° C. for one hour.

7. The varistor produced in accordance with the method of claim 1.

8. The varistor produced in accordance with the method of claim 4.

9. The varistor produced in accordance with the method of claim 5.

10. A method for controlling the intrinsic capacitance of a body of sintered zinc oxide based varistor material, said body possessing at least two substantially planar, parallel surfaces for electrode attachment, said body nonetheless retaining the nonohmic voltage-current properties of said varistor material, said method comprising:

diffusing lithium into the bulk of said varistor material by applying, to at least one of said parallel, planar surfaces of said varistor body, a composition consisting essentially of lithium as the active constituent, and then by heating said varistor material at elevated temperatures for a time sufficient to cause diffusion of at least a portion of said lithium into said varistor body, whereby the intrinsic capacitance of said varistor material decreases as the concentration of diffused lithium therein increases; and attaching at least one electrode to said planar surface having said lithium composition applied thereto.

11. The method of claim 10 wherein said composition comprises a solution of at least one compound selected from the group consisting of $LiNO_3$ and $Li_2O$.

12. The method of claim 10 further comprising the step of evaporating the solvent in said solution prior to said step of heating.

13. The method of claim 10 wherein the surface concentration of lithium applied to said varistor material is less than 2 mg/cm$^2$.

14. The method of claim 13 wherein said step of heating comprises heating said varistor material at a temperature of between 500° C. and 1100° C.

15. The method of claim 14 wherein said varistor comprises a composition consisting essentially of 0.5 mole percent each of $Bi_2O_3$, $Co_2O_3$, $MnO_2$, and $SnO_2$, 0.1 mole percent each of $H_3BO_3$ and $BaCO_3$, 1 mole percent $Sb_2O_3$, the remainder being ZnO.

16. The method of claim 15 wherein said step of heating comprises heating said varistor material at 800° C. for one hour.

17. The varistor produced in accordance with the method of claim 10.

18. The varistor produced in accordance with the method of claim 14.

19. The varistor produced in accordance with the method of claim 15.

* * * * *